US008622141B2

(12) United States Patent
Fay

(10) Patent No.: US 8,622,141 B2
(45) Date of Patent: Jan. 7, 2014

(54) DEGRADABLE NO-GO COMPONENT

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 232 days.

(21) Appl. No.: 13/211,042

(22) Filed: Aug. 16, 2011

(65) Prior Publication Data

US 2013/0043047 A1 Feb. 21, 2013

(51) Int. Cl.
*E21B 23/02* (2006.01)

(52) U.S. Cl.
USPC ..... 166/376; 166/382; 166/212

(58) Field of Classification Search
USPC ..... 166/376, 382, 208, 212
See application file for complete search history.

(56) References Cited

U.S. PATENT DOCUMENTS

| | | | | |
|---|---|---|---|---|
| 3,211,232 | A | 10/1965 | Grimmer | |
| 4,537,255 | A | 8/1985 | Regalbuto et al. | |
| 4,949,788 | A | 8/1990 | Szarka et al. | |
| 4,991,654 | A | 2/1991 | Brandell et al. | |
| 5,333,689 | A | 8/1994 | Jones et al. | |
| 5,479,986 | A | 1/1996 | Gano et al. | |
| 5,501,276 | A | 3/1996 | Weaver et al. | |
| 5,558,153 | A | 9/1996 | Holcombe et al. | |
| 5,607,017 | A | 3/1997 | Owens et al. | |
| 5,623,993 | A | 4/1997 | Van Buskirk et al. | |
| 5,685,372 | A | 11/1997 | Gano | |
| 5,709,269 | A * | 1/1998 | Head | 166/376 |
| 5,765,641 | A | 6/1998 | Shy et al. | |
| 6,026,903 | A | 2/2000 | Shy et al. | |
| 6,062,310 | A | 5/2000 | Wesson et al. | |
| 6,076,600 | A | 6/2000 | Vick, Jr. et al. | |
| 6,161,622 | A | 12/2000 | Robb et al. | |
| 6,220,350 | B1 | 4/2001 | Brothers et al. | |
| 6,289,991 | B1 | 9/2001 | French | |
| 6,397,950 | B1 | 6/2002 | Streich et al. | |
| 6,431,276 | B1 | 8/2002 | Robb et al. | |
| 6,926,086 | B2 | 8/2005 | Patterson et al. | |
| 7,093,664 | B2 | 8/2006 | Todd et al. | |
| 7,325,617 | B2 | 2/2008 | Murray | |
| 7,350,582 | B2 | 4/2008 | McKeachnie et al. | |
| 7,353,879 | B2 | 4/2008 | Todd et al. | |
| 7,395,856 | B2 | 7/2008 | Murray | |
| 7,464,764 | B2 | 12/2008 | Xu | |
| 7,625,846 | B2 | 12/2009 | Cooke, Jr. | |
| 7,628,210 | B2 | 12/2009 | Avant et al. | |
| 7,644,772 | B2 | 1/2010 | Avant et al. | |
| 7,726,406 | B2 | 6/2010 | Xu | |
| 7,775,286 | B2 | 8/2010 | Duphorne | |
| 7,798,236 | B2 | 9/2010 | McKeachnie et al. | |

(Continued)

OTHER PUBLICATIONS

BXN Seating Nipples; Bricco Oil Tools, A Division of Brico Holding Inc.; www.brocoolltools.com; Product No. 36-14—p. 4 of 4—Revised Jun. 10, 2009.

(Continued)

*Primary Examiner* — William P Neuder
(74) *Attorney, Agent, or Firm* — Cantor Colburn LLP

(57) ABSTRACT

A system for setting and retrieving a tool including a tubular having a first profile and a tool having a second profile, the first and second profiles complementarily formed and engagable together for enabling the tool to be located in a borehole with respect to the tubular, the first profile or the second profile at least partially formed from a degradable material, the degradable material degradable upon exposure to a downhole fluid.

20 Claims, 4 Drawing Sheets

(56) References Cited

U.S. PATENT DOCUMENTS

| | | | | |
|---|---|---|---|---|
| 7,909,108 | B2 * | 3/2011 | Swor et al. | 166/383 |
| 8,079,413 | B2 * | 12/2011 | Frazier | 166/124 |
| 2003/0141064 | A1 | 7/2003 | Roberson, Jr. | |
| 2003/0168214 | A1 | 9/2003 | Sollesnes | |
| 2005/0092363 | A1 | 5/2005 | Richard et al. | |
| 2005/0161224 | A1 | 7/2005 | Starr et al. | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2005/0281968 | A1 | 12/2005 | Shanholtz et al. | |
| 2006/0021748 | A1 | 2/2006 | Swor et al. | |
| 2006/0131031 | A1 | 6/2006 | McKeachnie et al. | |
| 2006/0266518 | A1 | 11/2006 | Woloson | |
| 2007/0074873 | A1 | 4/2007 | McKeachnie et al. | |
| 2008/0066923 | A1 | 3/2008 | Xu | |
| 2008/0066924 | A1 | 3/2008 | Xu | |
| 2009/0044948 | A1 | 2/2009 | Avant et al. | |
| 2009/0107684 | A1 | 4/2009 | Cooke, Jr. | |
| 2010/0032151 | A1 | 2/2010 | Duphorne | |
| 2010/0155050 | A1 | 6/2010 | Frazier | |

OTHER PUBLICATIONS

D.W. Thomson, et al., Design and Installation of a Cost-Effective Completion System for Horizontal Chalk Wells Where Multiple Zones Require Acid Stimulation, SPE Drilling & Completion, Sep. 1998, pp. 151-156, Offshore Technology Conference, U.S.A.

H.A. Nasr-El-Din, et al., Laboratory Evaluation Biosealers, Feb. 13, 2001, pp. 1-11, SPE 65017, Society of Petroleum Engineers Inc., U.S.A.

X. Li, et al., An Integrated Transport Model for BallSealer Diversion in Vertical and Horizontal Wells, Oct. 9, 2005, pp. 1-9, SPE 96339, Society of Petroleum Engineers, U.S.A.

* cited by examiner

DEGRADABLE NO-GO COMPONENT

BACKGROUND

Tools in the downhole drilling and completions industry are often located in a borehole by the use of no-go profiles (or landing nipples, radially inner restrictions, etc.). While these no-go profiles are relied upon for providing positive indication that a tool is properly set, too much load on the tool can deform or swage the tool and/or the no-go profile. If a tool becomes swaged into a no-go profile, retrieval of the tool can become difficult and the tool and profile can become damaged. As a result, advances to the setting and subsequent retrieval of tools, particularly those overcoming the above problems, are well received by the industry.

BRIEF DESCRIPTION

A system for setting and retrieving a tool including a tubular having a first profile and a tool having a second profile, the first and second profiles complementarily formed and engagable together for enabling the tool to be located in a borehole with respect to the tubular, the first profile or the second profile at least partially formed from a degradable material, the degradable material degradable upon exposure to a downhole fluid.

A system for setting and retrieving a tool including an engagement including a first profile of a first component and a second profile of a second component, the engagement operatively arranged for locating the first component in a borehole with respect to the second component, the first profile at least partially degradable by exposure to a downhole fluid.

A component of a no-go engagement including a first profile operatively arranged to engage with a second profile of the no-go engagement for locating a tool downhole, the first profile at least partially degradable upon exposure to a downhole fluid.

A method of setting and retrieving a tool downhole including landing a first profile of a tool at a second profile of a tubular, exposing the first profile or the second profile to a downhole fluid for degrading the first profile or the second profile at least partially.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
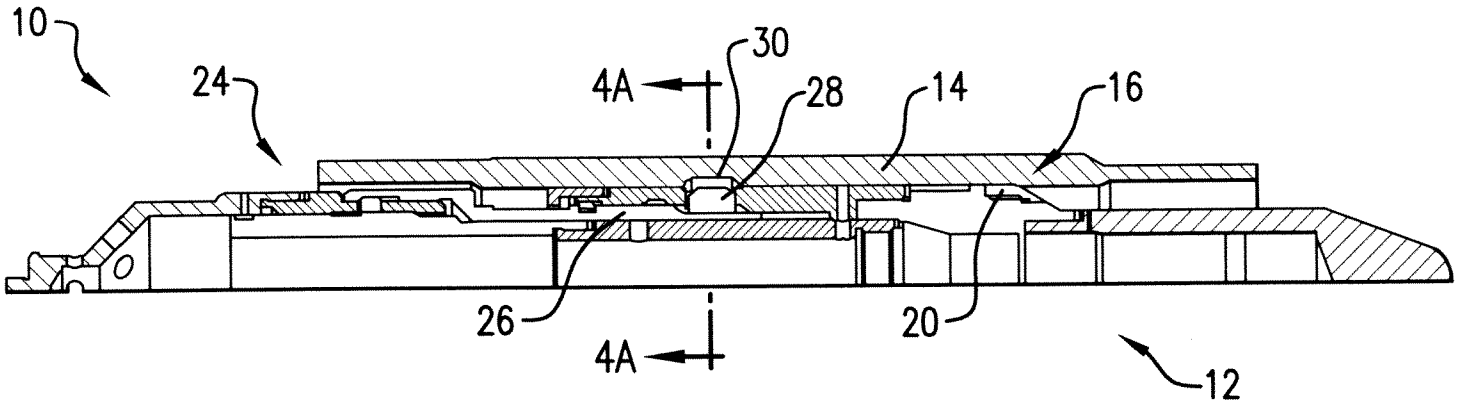
FIG. 1 is a quarter-sectional view of a system having a no-go engagement between a tubular and a tool.
Figure 2:
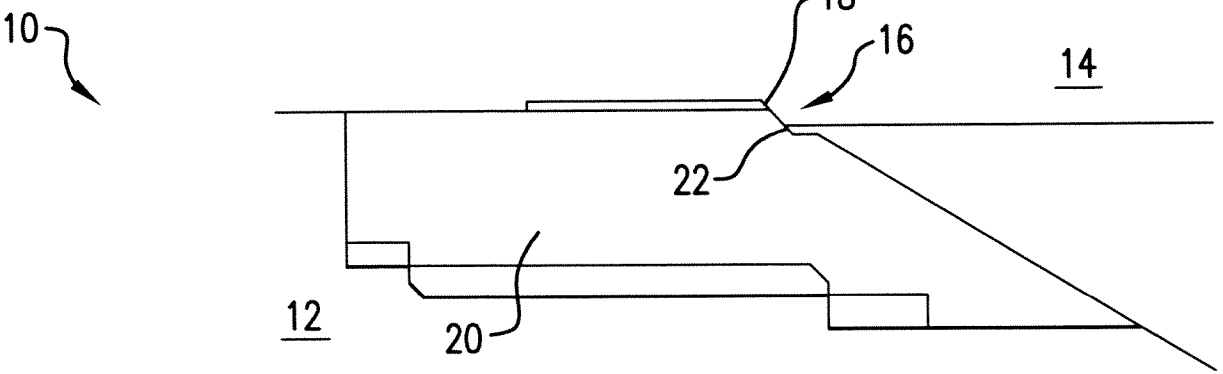
FIG. 2 is an enlarged view of the area generally encircled in FIG. 1.

Referring now to FIG. 1, a system 10 is shown having a tool 12 being run in a tubular 14. As shown in more detail in FIG. 2, the system 10 includes a no-go engagement 16 comprising a landing profile 18 on the tubular 14 and a no-go ring 20 on the tool 12 having a corresponding profile 22. Once received at the landing profile 18, positive interference or radial overlap with the profile 22 of the ring 20 prevents the tool 12 from traveling further downhole. The tool 12 is illustrated throughout the Figures in the form of a lock mandrel, but it will be appreciated that other tools or downhole components (the term "tool" used collectively herein) could utilize the no-go engagement of the current invention. That is, for example, tools benefiting from the current invention include those that carry a load in excess of the setting load such as plugs, tubing hangers, check valves, etc.

Figure 3:
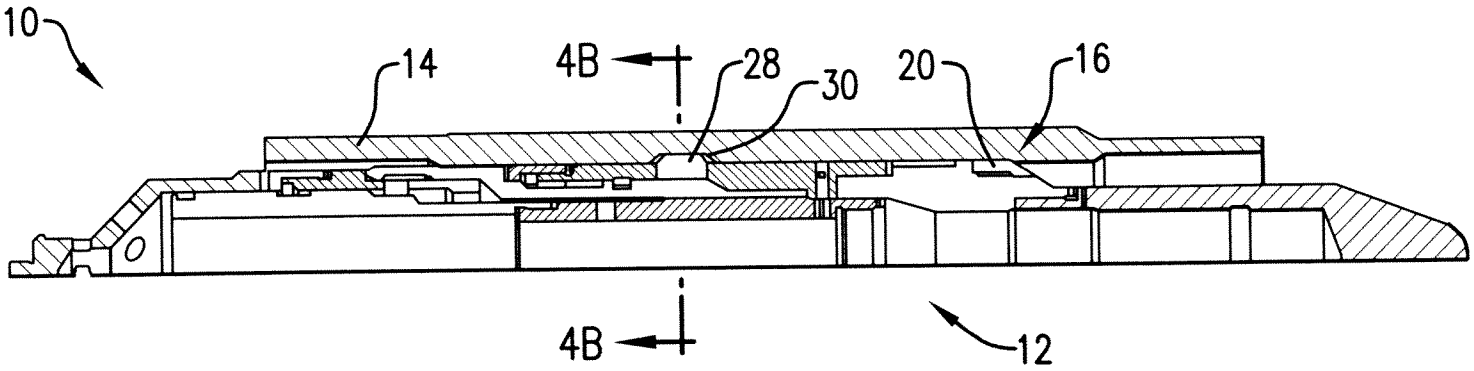
FIG. 3 is a quarter-sectional view of the system of FIG. 1 having dogs of the tool set into recesses of the tubular.
Figure 4B:
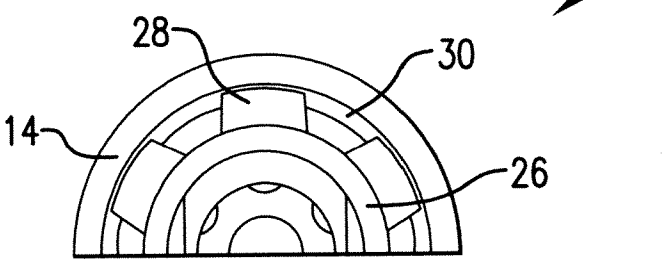
FIG. 4B is a cross-sectional view of the system taken generally along line 4B-4B in FIG. 1.
Figure 4A:
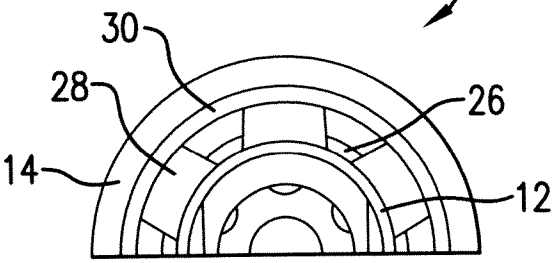
FIG. 4A is a cross-sectional view of the system taken generally along line 4A-4A in FIG. 1.

Accordingly, after landing at the profile 18, a setting load is applied to the tool 12, specifically on a sub 24 for the tool 12. The sub 24 includes a mandrel 26 for engaging with one or more dogs 28 and expanding the dogs 28 radially outwardly into complementarily formed recesses 30 in the tubular 14, as shown in FIG. 3. This creates positive interference or a radial overlap between the dogs 28 and the tubular 14, which can be appreciated by comparing FIGS. 4A and 4B.

Under high pressure or an additional force or load after being set (e.g., the tool including or being formed as a plug housing, check valve retainer, tubing hanger, etc., as noted above), the tool 12 is shifted downhole such that the dogs 28 result in an engagement at a surface 32 of the recesses 30, as shown in FIG. 4. Once the dogs 28 are fully engaged against the walls of the recesses 30, the tubular 14, via the dogs 28, picks up the weight of the tool 12 and any components hanging therefrom or pressures applied thereto.

Figure 5:
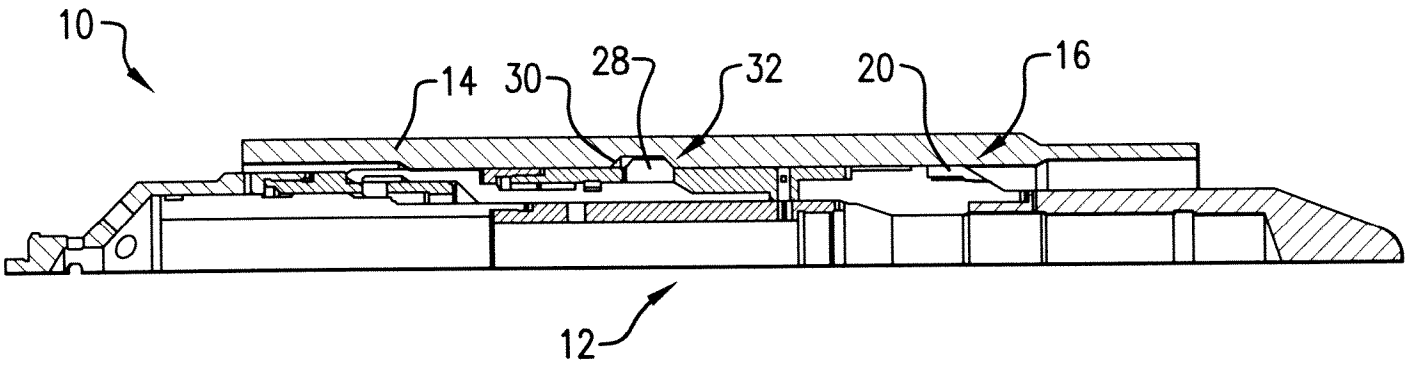
FIG. 5 is a quarter-sectional view of the system of FIG. 1 after application of an additional load on the tool.

Shifting the dogs 28 downhole to engage at the surface 32, however, causes the ring 20 of the tool 12 to also shift downhole, becoming swaged into the landing profile 18 of the tubular 14. As shown in more detail in FIG. 5, the ring 20 is deformed a distance D into the landing profile 18 of the tubular 12. This swaging makes retrieval of the tool 12 difficult as it significantly increases the force required to pull the ring 20, and therefore the tool 12, free of the tubular 14.

Figure 6:
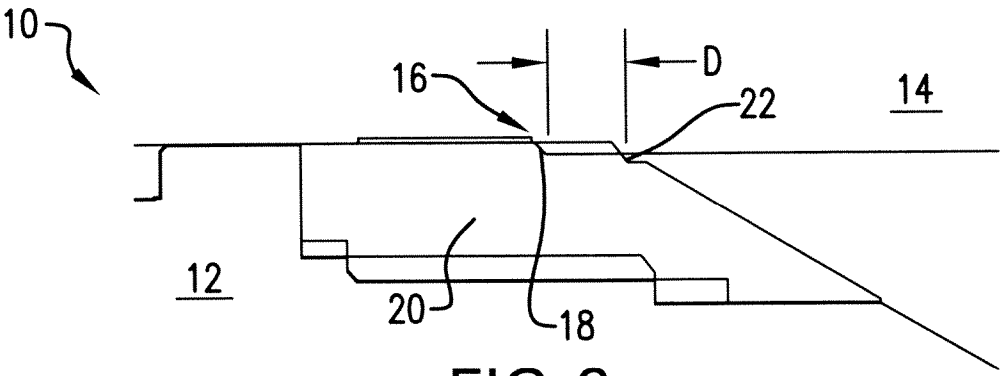
FIG. 6 is an enlarged view of area generally encircled in FIG. 5.
Figure 7:
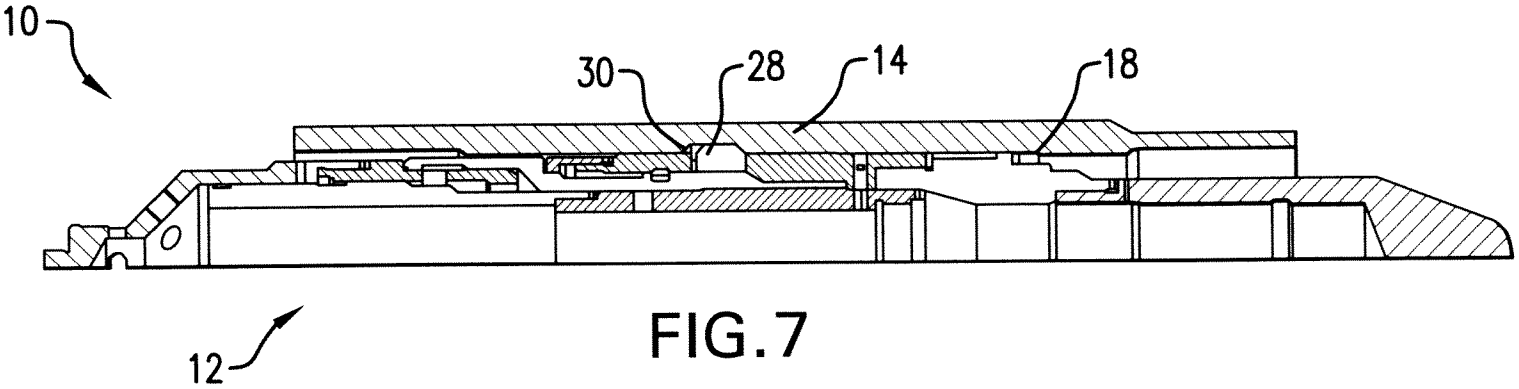
FIG. 7 is a quarter-sectional view of the system of FIG. 1 after a ring of the no-go engagement has been removed by degradation.

In order to facilitate the retrieval of the tool 12 in the system 10, the no-go engagement 16 is at least partially degradable. "Degradable" is intended to mean that the ring is disintegratable, dissolvable, corrodible, consumable, or otherwise removable. It is to be understood that use herein of the term "degrade", or any of its forms, incorporates the stated meaning. The ring 20 is formed as any known degradable material, such as a metal, polymer, composite, etc. that is removed or weakened by exposure to a downhole fluid, for example, water, oil, acid, brine, etc. In FIG. 6 the ring 20 has been removed by exposure to one of the downhole fluids, for example, by spotting acid to the ring 20. In another example, the material of the ring 20 could be selected such that is degrades more slowly over time, and is sufficiently weakened or removed by the time any additional load is applied to the tool 12. Once the ring 20 is removed, there is no longer a swaged engagement of the tool 12 with the tubular 14, thereby facilitating removal of the tool 12. It is also to be appreciated that degrading of the ring 20 could occur before application of the additional pressure or force on the tool 12, such that swaging never occurs, in which case the dogs 28 would engage with the surface 32 before the application of any additional pressures, loads, or forces (e.g., for or with operation of a plug, check valve, tubing hanger, etc.).

Although the system 10 is shown with the tool 12 disposed radially inwardly of the tubular 14, in another embodiment a tool could be located radially outwardly of a tubular, with a degradable ring disposed radially inwardly of the tool. In another embodiment, the degradable ring could be formed as part of the tubular with the tool including a non-degradable landing profile. The ring 20 could be a c-ring, a full ring held by a retainer, a full ring that is press fit onto or into the tool or tubular, etc. Furthermore, although the term "ring" is used consistently herein, it is to be appreciated that other members or portions of a non-go engagement could be used for decreasing the amount of undesirable swaging between two components in order to facilitate retrieval of one or both of the components.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A system for setting and retrieving a tool comprising:

a tubular having a radially extending first profile; and a tool configured to be landed on the tubular, the tool having a second profile configured to be received at the first profile to land the tool on the tubular, the first and second profiles complementarily formed and engagable together for enabling the tool to be located in a borehole with respect to the tubular, the second profile at least partially formed from a degradable material, the degradable material degradable upon exposure to a downhole fluid.

2. The system of claim 1, wherein the tool includes a ring, the ring including the second profile and at least partially formed from the degradable material.

3. The system of claim 1, wherein the second profile is configured to engage the first profile in response to axially shifting the tool to maintain the tool at a location relative to the tubular, and release the tool from the first profile upon degradation of the degradable material.

4. The system of claim 1, wherein the tool includes at least one dog operatively arranged to engage with at least one corresponding recess in the tubular after the tool has been located.

5. The system of claim 4, wherein a mandrel engages the at least one dog and urges the at least one dog into the at least one corresponding recess in response to a setting force.

6. The system of claim 5, wherein the tool is subjected to a force exceeding the setting force after engagement of the at least one dog with the at least one corresponding recess.

7. The system of claim 6, wherein the force swages the first profile with the second profile.

8. The system of claim 5, wherein the tool is arranged for a plug, check valve, or tubing hanger.

9. The system of claim 5, wherein the recess is operatively arranged to enable the tubular to pick up a weight of the tool via the at least one dog.

10. The system of claim 1, wherein the tool comprises a lock mandrel.

11. The system of claim 1, wherein the degradable material comprises a metal, polymer, composite, or combinations including at least one of the foregoing.

12. The system of claim 1, wherein the downhole fluid is acid, water, brine, oil, or combinations including at least one of the foregoing.

13. A system for setting and retrieving a tool comprising:

an engagement including a first profile of a first component and a second radially extending profile of a tubular second component, the engagement operatively arranged for locating the first component in a borehole with respect to the second component by landing the first profile on the second profile, the first profile at least partially degradable by exposure to a downhole fluid.

14. A component of a no-go engagement comprising:

a first profile of a tool operatively arranged to engage with a second profile of the no-go engagement for locating the tool downhole, the second profile having a radially extending portion configured to engage the tool by landing the first profile on the second profile, the first profile at least partially degradable upon exposure to a downhole fluid.

15. The component of claim 14, wherein the tool comprises the component.

16. A method of setting and retrieving a tool downhole comprising:

landing a first profile of a tool at a second radially extending profile of a tubular by axially moving the tool relative to the tubular;

exposing the first profile to a downhole fluid for degrading the first profile or the second profile at least partially.

17. The method of claim 16, further comprising setting the tool by applying a first force thereto.

18. The method of claim 17, wherein setting the tool comprises radially moving at least one dog of the tool into at least one corresponding recess in the tubular.

19. The method of claim 18, further comprising loading the tool with a second force for engaging the at least one dog with a surface of the at least one corresponding recess.

20. The method of claim 19, wherein loading of the tool occurs before exposing the first profile or the second profile and the second force swages the first and second profiles together.

* * * * *